US009227444B1

(12) United States Patent
Ben-Noon

(10) Patent No.: US 9,227,444 B1
(45) Date of Patent: Jan. 5, 2016

(54) INKJET PRINT HEADS ALIGNMENT ASSEMBLY, KITS AND METHODS

(71) Applicant: Nano-Dimension Technologies, Ltd., Nes Ziona (IL)

(72) Inventor: Dagi Ben-Noon, Olesh (IL)

(73) Assignee: Nano Dimensions Technologies Ltd., Nes Ziona (IL)

( * ) Notice: Subject to any disclaimer, the term of this patent is extended or adjusted under 35 U.S.C. 154(b) by 0 days.

(21) Appl. No.: 14/673,139

(22) Filed: Mar. 30, 2015

(51) Int. Cl.

| | |
|---|---|
| ***B41J 29/393*** | (2006.01) |
| ***B41J 25/308*** | (2006.01) |
| ***B41J 2/045*** | (2006.01) |
| ***B41J 25/00*** | (2006.01) |
| ***B41J 2/335*** | (2006.01) |
| ***B41J 2/51*** | (2006.01) |

(52) U.S. Cl.
CPC ..... *B41J 25/308* (2013.01); *B41J 2/04505* (2013.01); *B41J 2/04506* (2013.01); *B41J 2/33575* (2013.01); *B41J 2/512* (2013.01); *B41J 25/001* (2013.01); *B41J 25/3086* (2013.01); *B41J 25/3088* (2013.01); *B41J 2202/19* (2013.01)

(58) Field of Classification Search
CPC .. B41J 25/308; B41J 25/3086; B41J 25/3088; B41J 2202/19; B41J 2/04505; B41J 2/04506; B41J 25/001; B41J 2/33575; B41J 2/512
See application file for complete search history.

(56) References Cited

U.S. PATENT DOCUMENTS

| | | | | |
|---|---|---|---|---|
| 6,382,752 | B1 * | 5/2002 | Riou | 347/8 |
| 2008/0186353 | A1 * | 8/2008 | Parks et al. | 347/37 |
| 2010/0289852 | A1 * | 11/2010 | Woolfe et al. | 347/37 |
| 2014/0168293 | A1 * | 6/2014 | Moreau et al. | 347/2 |

FOREIGN PATENT DOCUMENTS

| | | | | |
|---|---|---|---|---|
| JP | 59-96968 | * | 4/1984 | B41J 25/308 |

* cited by examiner

*Primary Examiner* — Julian Huffman
(74) *Attorney, Agent, or Firm* — The IP Law Firm of Guy Levi, LLC; Guy Levi

(57) ABSTRACT

The disclosure relates to assemblies, kits and methods for alignment of inkjet print heads. More particularly, the disclosure relates to assemblies, kits and methods facilitating the alignment of inkjet printheads by selectably modulating the printheads' phase, registration, and yaw relative to the printing direction and optionally, with respect to an additional printhead or printheads.

19 Claims, 8 Drawing Sheets

INKJET PRINT HEADS ALIGNMENT ASSEMBLY, KITS AND METHODS

BACKGROUND

The disclosure is directed to assembly for aligning inkjet printheads. More specifically, the disclosure is directed to inkjet printheads alignment system providing alignment of up to three (3) degrees of freedom.

In various industrial Printhead Module (PMD) applications (e.g., the printing of printed circuit boards, PCBs), drop placement accuracy can be important. There are a variety of causes for inaccuracies in drop placement. These causes may include misalignment between printheads in an array, as well as misalignment of a substrate to be printed upon.

Most of the alignment errors follow from manufacturing tolerances, which can lead to small dimensional and form variations in the printer components. Likewise, vibrations and thermo-mechanical effects in the system can deteriorate the positioning accuracy of the printheads following extensive or intensive use.

For improving printhead alignment, tightening of manufacturing tolerances can be costly and time consuming. While the printers' performance requirements increase, it becomes necessary to provide the ability to align printhead modules with as great flexibility as possible.

There is therefore a need for an alignment assembly capable of providing alignment with as many degrees of freedom as possible.

SUMMARY

Disclosed, in various embodiments, are assemblies and methods for aligning inkjet printheads with up to three (3) degrees of freedom.

In an embodiment provided herein is a three dimension printhead aligning assembly comprising: a mounting platform having a front stage, a back stage and a pair of side rails connecting the front and back stages, the mounting platform comprising two linear phase actuators and defining an internal tetragonal space; a carriage operably coupled to the mounting platform, the carriage further comprising a phase translation anchor and a registration actuator; a sled, the sled nested within—and operably coupled to, the carriage; and an inkjet printheads, the printhead operably coupled to the sled respectively, wherein the assembly is configured to provide three degrees of freedom alignment of the printheads relative to the printing direction and optionally, with respect to a second printhead.

In another embodiment, provided herein is a kit comprising: a mounting platform having a front stage, a back stage and a pair of side rails connecting the front and back stages; a carriage; a sled; and an inkjet printhead, the mounting platform, carriage, sled and inkjet printhead configured to be assembled to form a three degrees of freedom printhead aligning assembly These and other features of the assemblies and methods for inkjet printheads alignment, will become apparent from the following detailed description when read in conjunction with the figures and examples, which are exemplary, not limiting.

BRIEF DESCRIPTION OF THE FIGURES

For a better understanding of the assemblies kits and methods for inkjet printheads alignment, with regard to the embodiments thereof, reference is made to the accompanying examples and figures, in which.

DETAILED DESCRIPTION

Figure 1:
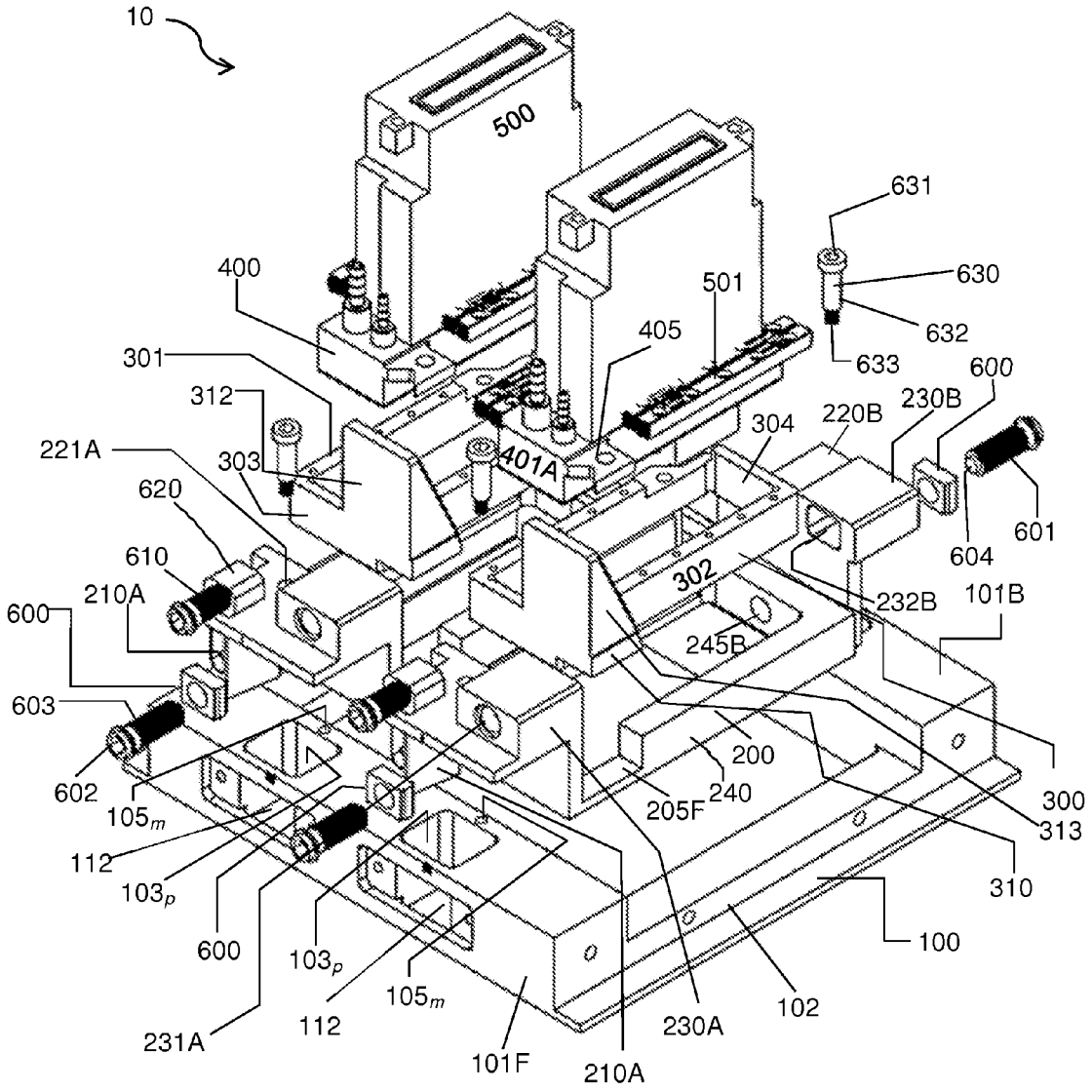
FIG. 1 illustrates an exploded isometric view of an embodiment of the assembly for inkjet printheads alignment.

Provided herein are embodiments of assemblies and methods for inkjet printheads' alignment.

In an embodiment, provided herein is a three dimension printheads aligning assembly comprising: a mounting platform having a front stage, a back stage and a pair of side rails connecting the front and back stages, the mounting platform comprising at least two linear phase actuators and defining at least two internal tetragonal spaces; twoa carriage operably coupled to the mounting platform, the carriage further comprising a phase translation anchor and a registration actuator; twoa sled, the sled nested within—and operably coupled to, the carriage; and twoan inkjet printhead, the printhead operably coupled to the sled, wherein the assembly is configured to provide three degrees of freedom alignment of the printhead relative to the printing direction, and optionally with respect to a second printhead. The alignment assembly can be adapted to accurately print "drop-over-drop" of ink from two different types of printheads, for example, a first conductive ink followed exactly on the same printing pattern with insulating ink, while leaving certain section non-insulated. Further printheads can be installed on the same platform using the same configuration.

An orifice plate, can be located on the printing side (lower surface) of the printinghead, providing access for the nozzles to print, while potentially also providing protection for the printing head. Jetted ink from each nozzle can exits the orifice for printing. Further, the more closely packed the nozzles of an array are, the better the print quality that can be achieved. Likewise, where the nozzle is displaceable, ink is ejected from the nozzle at a slight angle. Conversely, if nozzles in the array are directed to be displaced in opposite directions, i.e. as mirror images of one another, the ink droplets ejected from such nozzles are offset with respect to the perpendicular to a greater extent. This may result in a degradation of the print quality. Accordingly, it is beneficial to align or otherwise modulate the alignment of a single printhead to obtain the desired orientation of the nozzle array relative to the printing direction, or normal to the printing direction, and/or with respect to another (a second, third, fourth . . . n) printhead While showing mechanical actuators, other drivers can be used to affect the actuation of the various parts. These include servo motors, pneumatic actuators and the like.

The terms "first," "second," and the like, when used herein do not denote any order, quantity, or importance, but rather are used to denote one element from another. The terms "a", "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the head(s) includes one or more head). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

In addition, for the purposes of the present disclosure, directional or positional terms such as "top", "bottom", "upper," "lower," "side," "front," "frontal," "forward," "rear," "rearward," "back," "trailing," "above," "below," "left," "right," "radial," "vertical," "upward," "downward," "outer," "inner," "exterior," "interior," "intermediate," etc., are merely used for convenience in describing the various embodiments of the present disclosure.

The term "coupled", including its various forms such as "operably coupled", "coupling" or "coupleable", refers to and comprises any direct or indirect, structural coupling, connection or attachment, or adaptation or capability for such a direct or indirect structural or operational coupling, connection or attachment, including integrally formed components and components which are coupled via or through another component or by the forming process (e.g., an electromagnetic field). Indirect coupling may involve coupling through an intermediary member or adhesive, or abutting and otherwise resting against, whether frictionally (e.g., against a wall) or by separate means without any physical connection.

The term "engage" and various forms thereof, when used with reference to retention of a member (e.g., the detent), refer to the application of any forces that tend to hold two components together against inadvertent or undesired separating forces (e.g., such as may be introduced during use of either component). It is to be understood, however, that engagement does not in all cases require an interlocking connection that is maintained against every conceivable type or magnitude of separating force. Also, "engaging element" or "engaging member" refers to one or a plurality of coupled components, at least one of which is configured for releasably engaging a tab or detent. For example, the adjustment box can be considered an engaging element.

The term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives.

Further, the term "sled" as used herein should be broadly construed to mean a device which is moveable in the length direction of the corresponding rail. The sled and the rail may have one of many different forms in order to achieve this. In light of the disclosure a person skilled in the art may choose a suitable form for the sled. Likewise, the term "carriage" shall be broadly defined to include any component designed to carry something on or along something else. Likewise, the term "carriage member" refers to any member that translates the motion of a moving drive member into motion of an object that is mechanically coupled to the carriage member (e.g., the sled).

Moreover, the term "actuator" refers to a device or assembly for imparting movement. The term actuator also refers generally to any of a number of actuation devices which may be utilized in articulating various components (e.g., the carriage and/or the sled) in the disclosed alignment assembly. For example, electromechanical linear actuators, pneumatic cylinders, hydraulic cylinders, and air bladders are all contemplated as being applicable to one or more of the embodiments disclosed hereinbelow. Additionally, actuators may include other combinations of prime movers and links or members which may be utilized to actuate, move, transfer motion, articulate, lift, lower, rotate, extend, retract, or otherwise move links, linkages, platforms, stages, frames, carriages, sleds or any of the members of the alignment assembly discussed.

All ranges disclosed herein are inclusive of the endpoints, and the endpoints are independently combinable with each other. Furthermore, the terms "first," "second," and the like, herein do not denote any order, quantity, or importance, but rather are used to denote one element from another.

Likewise, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such.

A skilled person would readily recognize, that while throughout the disclosure, shapes are provided, for example, quadrilateral, tetragonal, rectangle, trapezoid, other shapes and polygons are likewise encompassed. So for example, a "substantially rectangular frame" can likewise be square, or for that matter, oval. determination of the shape of each frame will be made based on overall assembly constraints.

A more complete understanding of the components, processes, assemblies, and devices disclosed herein can be obtained by reference to the accompanying drawings. These figures (also referred to herein as "FIG.") are merely schematic representations (e.g., illustrations) based on convenience and the ease of demonstrating the present disclosure, and are, therefore, not intended to indicate relative size and dimensions of the devices or components thereof and/or to define or limit the scope of the exemplary embodiments. Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

Turning now to FIG. 1, illustrating an isometric exploded view of an embodiment of the alignment assembly described herein. As illustrated, the printheads aligning assembly 10 can comprise mounting platform 100 two (2) carriages 200 (or only one in another embodiment), operably coupled to mounting platform 100, each carriage 200 further comprising a phase translation anchor 630 and a registration actuator (not shown, see e.g., FIG. 2). System 10 can further comprise two (2) sleds 300 (or only one in another embodiment), each sled nested within—and operably coupled to, each of carriages 200 respectively; and two (2) inkjet printheads 500 (or only one in another embodiment), each printhead 500 operably coupled to each of sleds 300 respectively, via base 400, wherein assembly 10 is configured to provide three (3) degrees of freedom alignment of each of printheads 500 with respect to each other, and/or relative to the printing direction for each head. Also shown in FIG. 1, is cube-shaped alignment nut 600.

Figure 2:
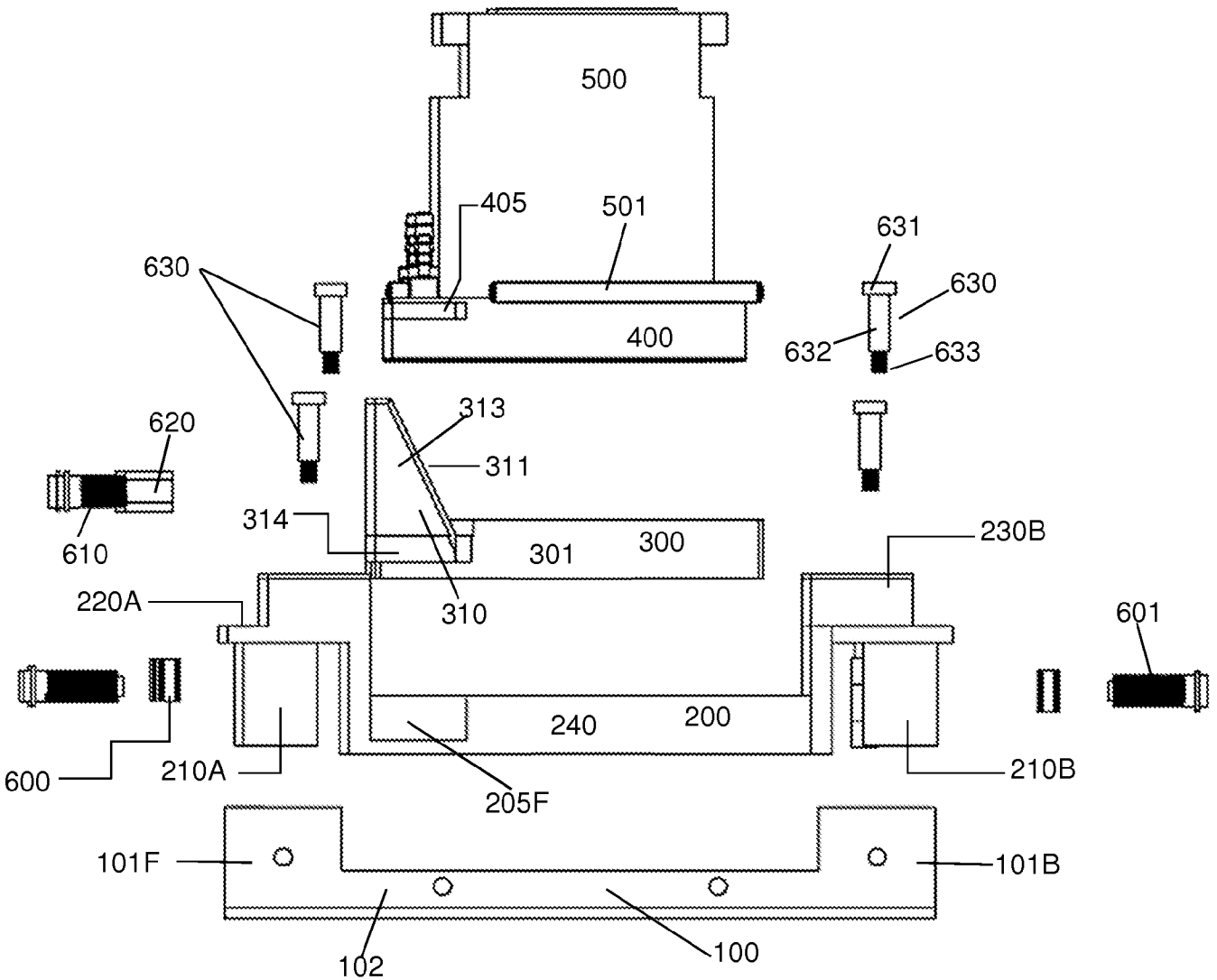
FIG. 2, illustrates an exploded left side elevation view of an embodiment of the assembly for inkjet printheads alignment illustrated in FIG. 1.
Figure 3:
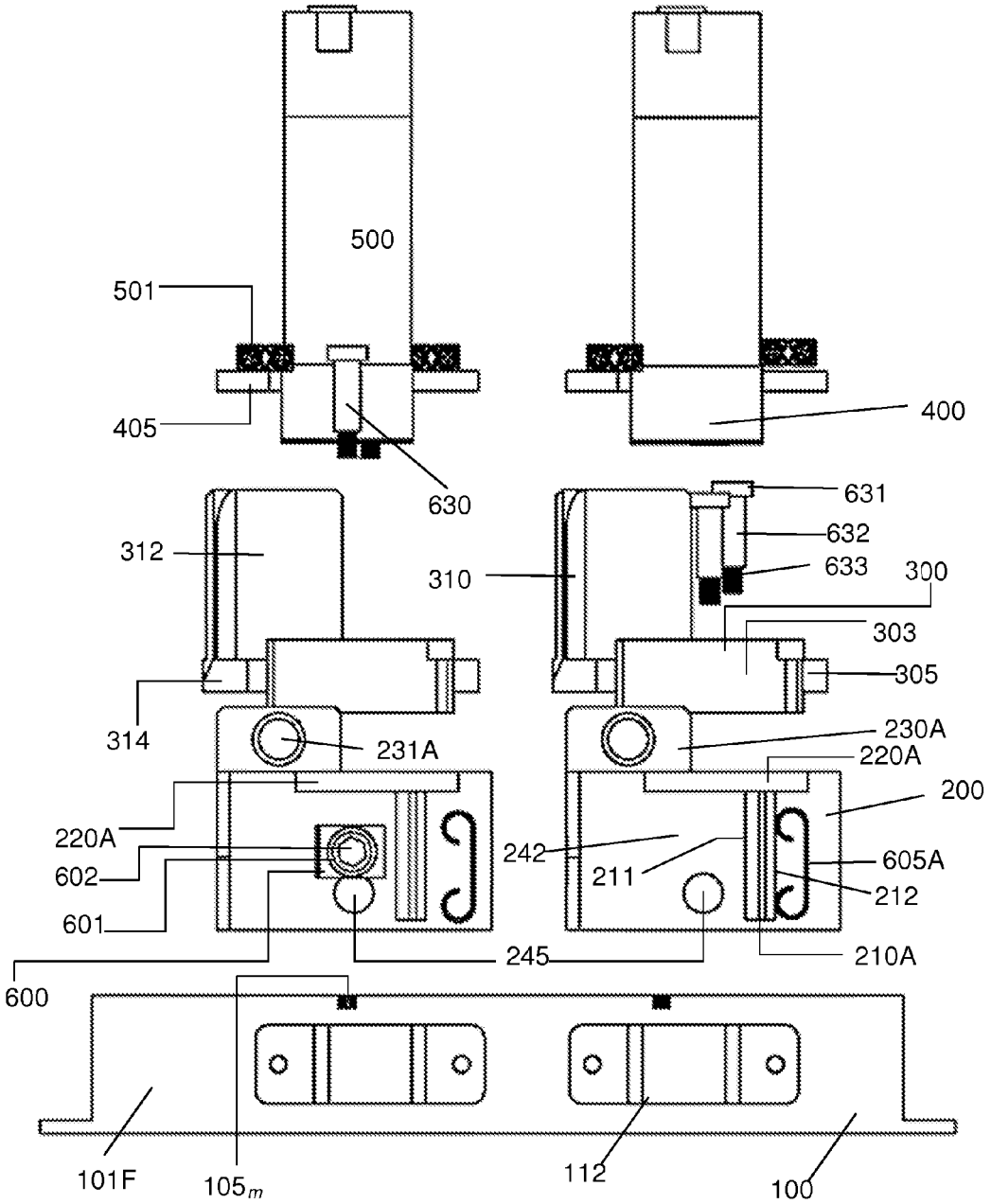
FIG. 3, illustrates an exploded front elevation view of an embodiment of the assembly for inkjet printheads alignment illustrated in FIG. 1.

Further, and as illustrated in FIGS. 1-3, alignment assembly 10 can be configured to provide each of printing head(s) 500 with as much as two degrees of freedom in Cartesian coordinates system and one degree of freedom in spherical coordinate system, resulting in a capability for aligning each of printheads 500 with three (3) DOF. The three degrees of freedom can be phase alignment (e.g., in the X direction, parallel with the printing direction or side-to-side), registration (e.g., in the Y direction, normal [90°] to the printing direction or front-to-back) and/or yaw (e.g., turn about a vertical axis at an angle θ, or angular movement in the Y-Z plane) or any permutation of the foregoing. Additionally, the terms "X-direction", "Y-direction", and "Z-direction" are interchangeably used with the corresponding terms "x-axis", "y-axis", and "z-axis", where the axis are directions of the Cartesian coordinate system.

Figure 4:
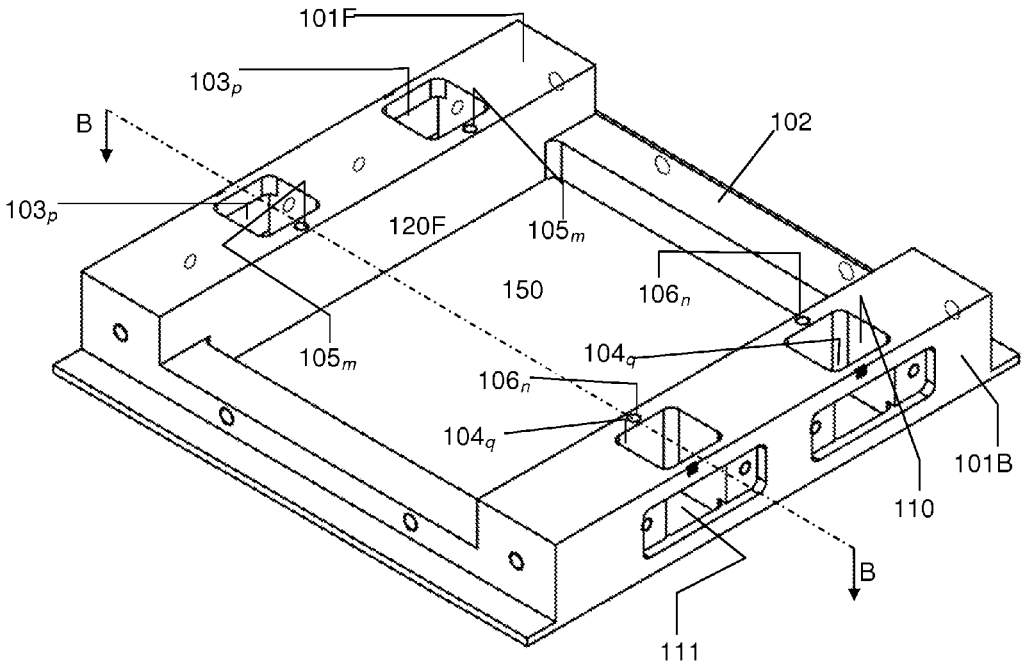
FIG. 4 illustrates a front elevation view of an embodiment of the mounting platform illustrated in FIG. 1.

Turning now to FIGS. 1-6, illustrating mounting platform 100. As illustrated in FIGS. 1 and 4, mounting platform 100 can have having front stage 101F, having an upper surface, a lower surface with a forward facing surface and internally facing surface 120F (or 120B) facing a quadrilateral opening 150 (other shaped opening can also be used). Mounting platform 100 can also have back stage 101B having an upper surface, a lower surface a rear facing surface and internally facing surface 120B facing quadrilateral opening 150. Additionally, mounting platform 100 can have and side rails 102 connecting the front and back stages 101F, 101B. Mounting platform 100 comprising at least two (2), linear phase actuators (not shown, see e.g., FIG. 1 with four linear phase actuators) and defining an internal quadrilateral space 150 (see e.g., FIG. 4).

Figure 9A:
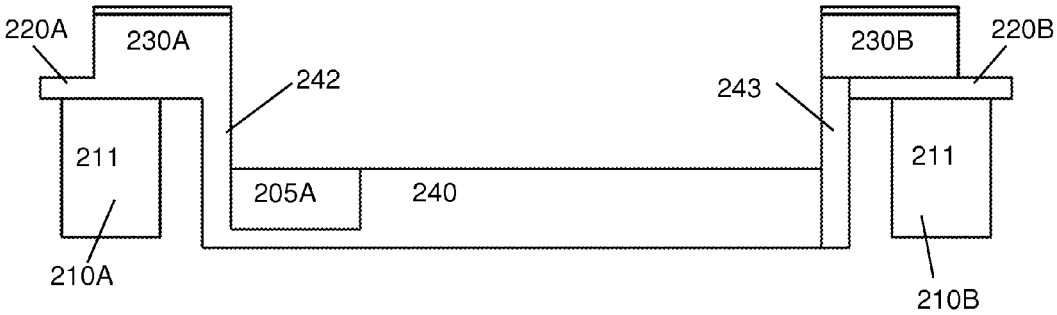
FIG. 9 A illustrates a side elevation view of an embodiment of the carriage illustrated in FIG. 7.
FIG. 9B illustrates a front elevation view thereof.

As illustrated in FIGS. 1-6, front stage 101F and back stage 101B of mounting platform 100 used in the alignment assemblies described herein, can comprise plurality of parallel tetragonal recess pairs $\mathbf{103}_p$, $\mathbf{104}_q$. The pair of front and back tetragonal $p^{th}$, $q^{th}$ recesses can be configured to receive and engage at least a portion of carriage 200 (See e.g., FIGS. 1, 3, and 9A) and the linear phase actuator. In addition, the $p^{th}$, $q^{th}$ tetragonal (in other words, having a general cage geometry) recess $\mathbf{103}_p$, $\mathbf{104}_q$ can define top opening 110 to the upper surface of front stage 101F and the upper surface of back stage 101B. Moreover, front stage 101F tetragonal recess $\mathbf{103}_p$ can further define front opening 112 (see e.g., FIGS. 5-6) to the forward facing surface (see e.g., FIG. 6), and each of back stage 101B tetragonal recess $\mathbf{104}_q$ can define a rear opening 111 to the rear facing surface (see e.g., FIG. 1).

Figure 5:
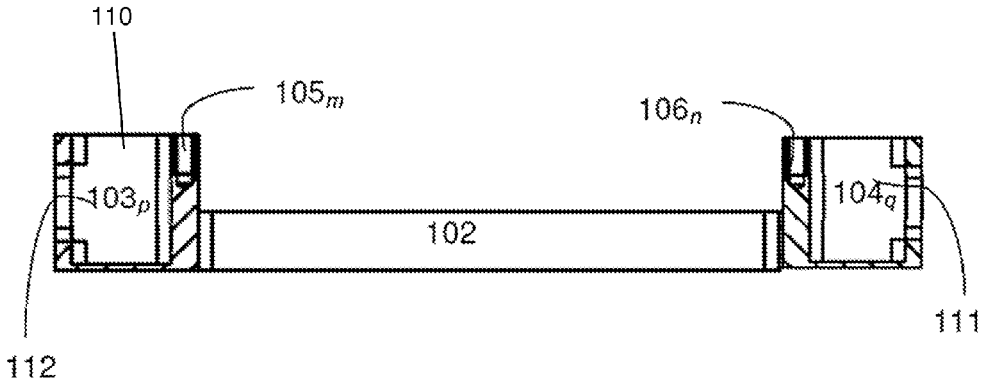
FIG. 5 illustrates a schematic X-Z cross section C-C view of an embodiment of the mounting platform illustrated in FIG. 4.
Figure 6:
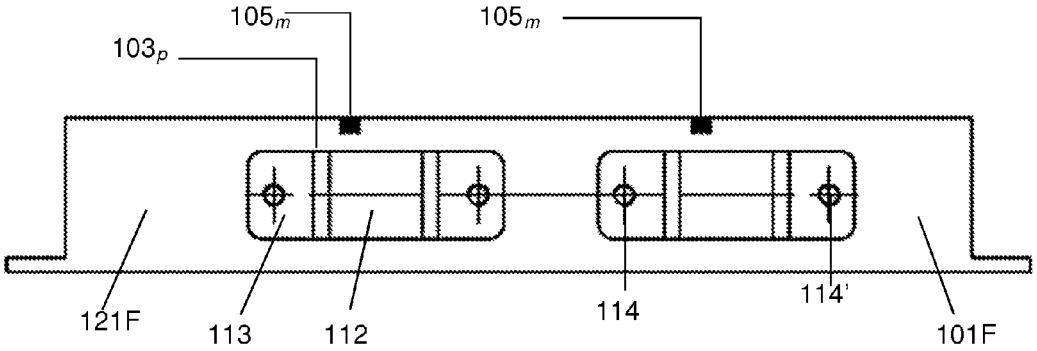
FIG. 6, illustrates a front elevation view of the embodiment of the mounting platform illustrated in FIG. 4.

As further illustrated in FIGS. 4 and 5, front stage bore $\mathbf{105}_m$ and back stage bore $\mathbf{106}_n$ of the mounting platform 100 used in the alignment assemblies described herein, can be disposed between each front stage 101F recess $\mathbf{103}_p$, back stage 101B recess $\mathbf{104}_q$ and the internal space defined by front stage 101F, back stage 101B and the side rails 102. As illustrated, bores $\mathbf{105}_m$, $\mathbf{106}_n$ can be disposed at the center of the upper surface opening 110, and form an anchor point for carriage 200 (see e.g., FIG., element 630).

Figure 7:
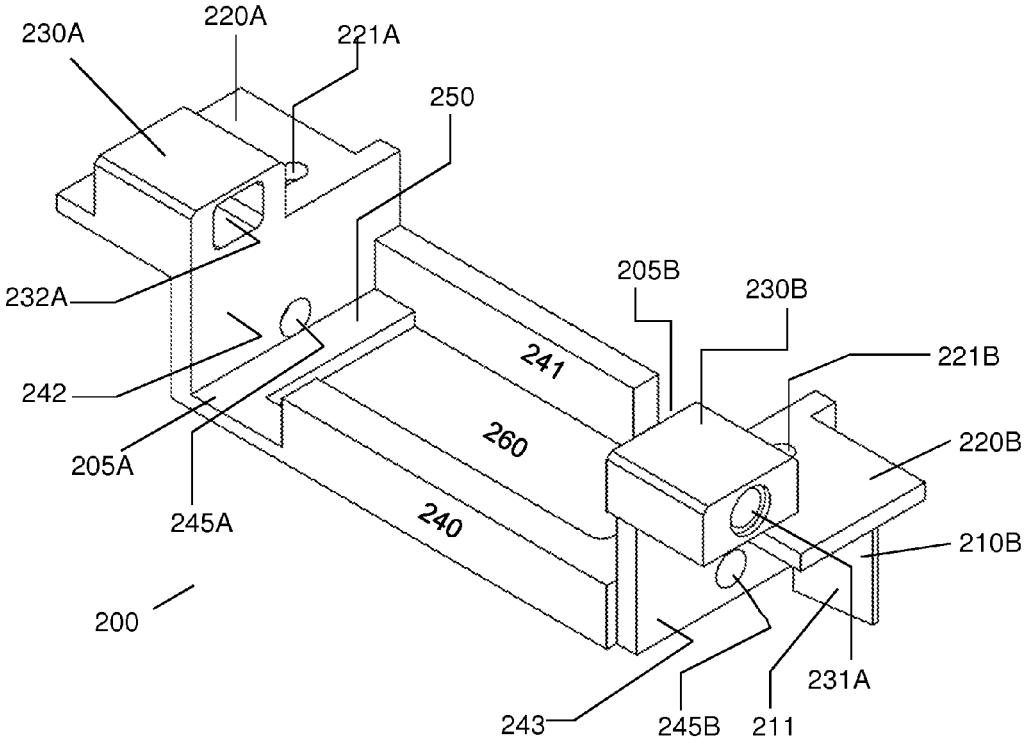
FIG. 7, illustrates a top isometric view of an embodiment of the carriage.
Figure 8:
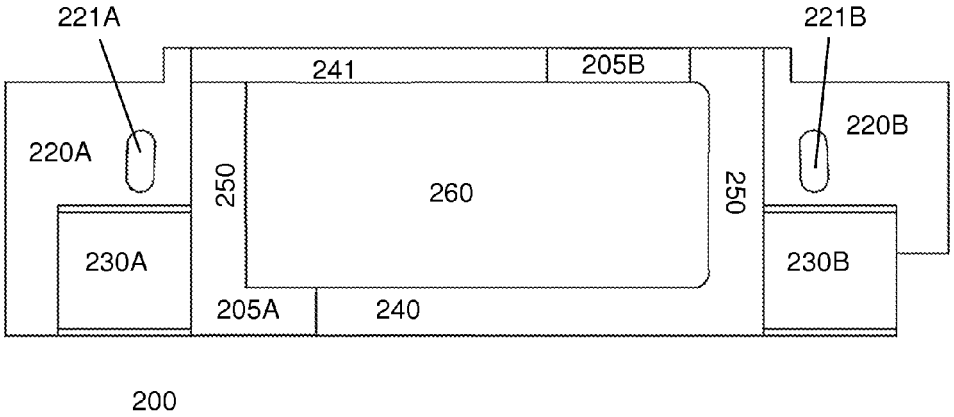
FIG. 8, illustrates a top plan view of the embodiment of the carriage illustrated in FIG. 7.

Turning now to FIGS. 2-3, 7, 8, 9A and 9B, illustrating embodiments of carriage 200. as illustrated, carriage 200 can have a substantially rectangular frame having a longitudinal axis (not shown) with pair of long longitudinal side walls 240, 241 connected by shorter front 242 and back 243 transverse walls (see e.g., FIG. 7). As indicated, the frame can have other polygonal shapes and internal opening shapes. The 240, 241, 242, and 243 walls are illustrated as rising from the edges of a substantially rectangular floor plate 250 defining a substantially rectangular opening 260 therein. The floor can be considered a ledge to receive and support sled 300 (see e.g., FIG. 2), while side walls 240, and 241, can be configured to have a top portion aligned with the top portion 301, 302 of sled 300, and slidably couple to npreinhead 500 rails 501 (see e.g., FIG. 1).

Carriage 200 used in the alignment assemblies described herein, can comprise front 220A and back 220B extension slabs, each having an upper surface and a lower surface. Front 220A and a back 220B extension slabs can each further defining slit 221A, 221B therein, configured to accommodate the phase translation anchor. As illustrated, slits 221A and 221B are elongated (e.g., having an aspect ratio>1), with a longitudinal axis of the opening (major axis) that is normal to the longitudinal axis of the carriage. The length of the openings' major axis can be used and modified to predetermine the carriage phase movement (e.g., in the x-axis).

Carriage 200 can further comprise front 210A and back 210B; phase and/or yaw adjustment tabs extending downward (see e.g., FIG. 8) from the lower surface of each front 220A and back 220B extension slab respectively. Front and back phase and/or yaw adjustment tabs 210A, 210B, each have respectively a beveled internal wall 211 and a straight external wall 212, defining a right angle trapezoid X-Y cross section. (see e.g., FIG. 3, 7, 9A, 9B).

Also shown e.g., in FIGS. 1-3 and 8, is front 230A and back 230B registration actuator's housing. As illustrated registration actuator housing is a tetragonal structure having a side wall that rises above the edge of each extension slab 220A, 220B, with an outward (to the front or rear) facing wall defining a threaded aperture 231A, 231B, and an open inward (to internal space 260 formed by carriage 200 walls) facing space.

In an embodiment, the term "accommodate" refers to the ability of an accommodating element to allow passage or retention of another element at close tolerance, without substantial space for other elements or components.

Figure 9B:
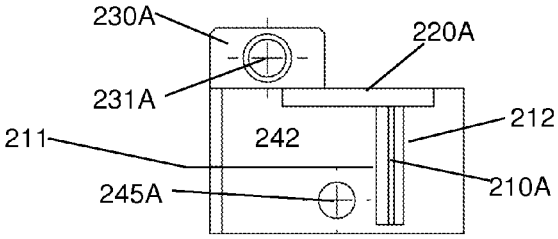
Figure 10:
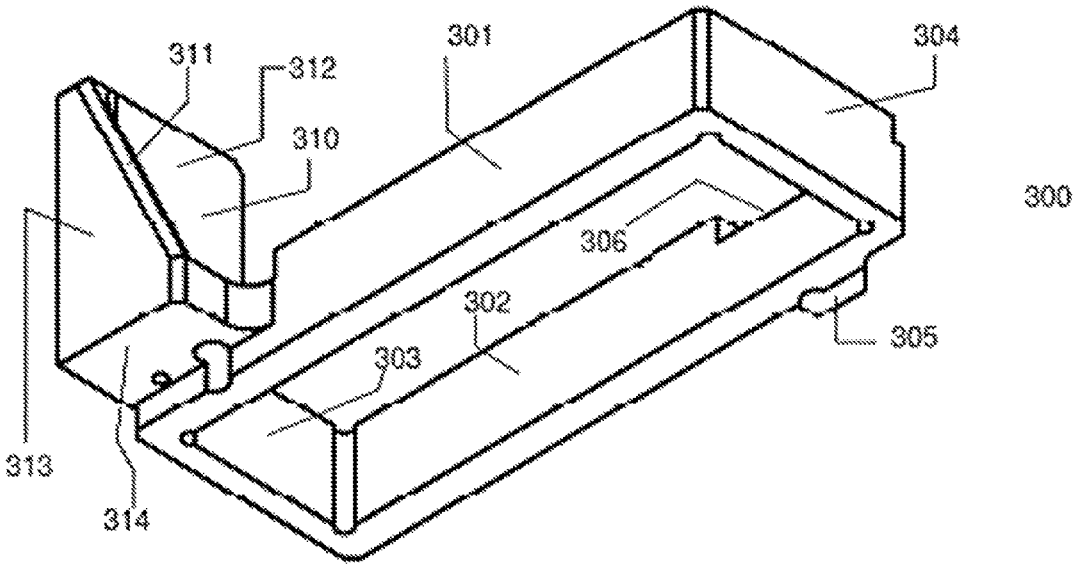
FIG. 10, illustrates a bottom isometric view of an embodiment of the sled.
Figure 11:
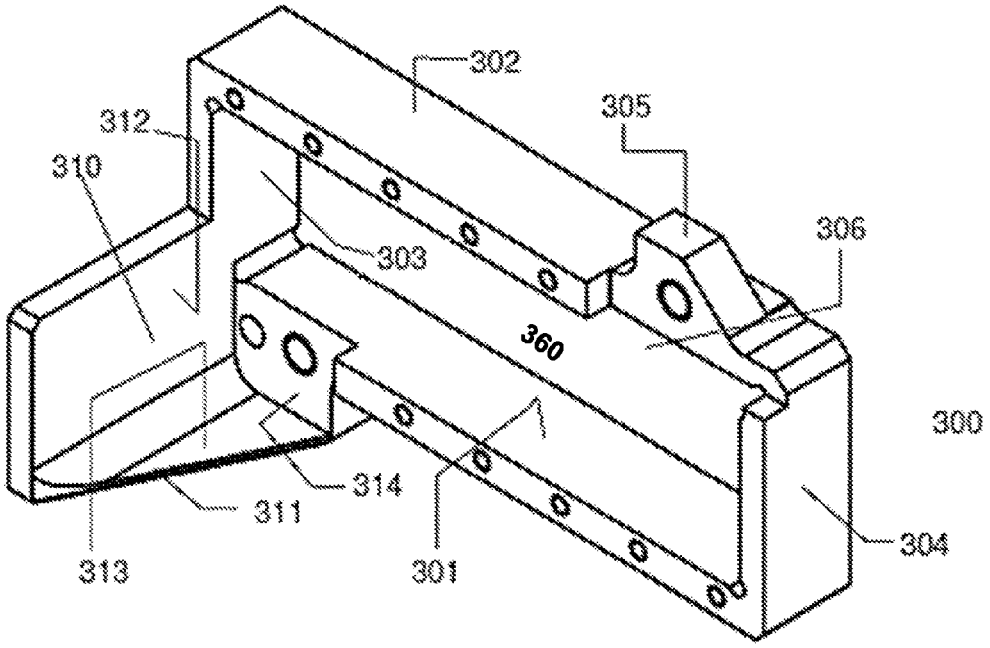
FIG. 11, illustrates a top/side isometric view of the sled embodiment illustrated in FIG. 10.

As illustrated e.g., in FIGS. 3, and 9B, front transverse wall 242 and back transverse wall 243 of carriage 200 used in the alignment assemblies described herein, can each further define a basal aperture 245A, 245B, configured to receive and accommodate at least a portion of the phase actuator. (see e.g., FIG. 3).

Turning now to FIGS. 3, 7 and 9B, front 210A and back 210B phase and/or yaw adjustment tabs extending downward from the lower surface of each front 220A and back 220B extension slab respectively define a right angle trapezoid X-Y cross section, with external wall 212, configured to abut a portion of the phase actuator, such as phase biasing elements 605A, 605B. Phase biasing elements 605A, 605B, can be (leaf e.g.,) springs, rubber rods or similar biasing elements and operate to bias adjustment tabs 210A, 210B away from the side walls of tetragonal recess pairs 103$_p$ and 104$_q$ disposed in front stage 101F and back stage 101B of mounting platform 100.

In an embodiment, the term "biasing element", or "biaser" refers to any device that provides a biasing force. Representative biasing elements include but are not limited to springs (e.g., elastomeric or metal springs, torsion springs, coil springs, leaf springs, tension springs, compression springs, extension springs, spiral springs, volute springs, flat springs, and the like), detents (e.g., spring-loaded detent balls, cones, wedges, cylinders, and the like), pneumatic devices, hydraulic devices, and the like, and combinations thereof.

Turning now to FIGS. 1-3, 10 and 11, illustrating embodiments of sled 300. As illustrated, sled 300 used in the alignment assemblies described herein, can define substantially rectangular open frame having a first 301 and second 302 long longitudinal side walls connected by shorter front 303 and back 304 transverse walls. Sled 300 can also comprise a generally L-shaped top plan view overhang 310 having an anterior wall 312 facing forward, wall 312 has an anterior surface extending above and continuous with front wall 303 of sled 300, with side wall 313, both walls (312, 313) rising from a base plate 314 extending laterally outward (in other words hanging over side wall 301) from the sled first longitudinal side wall 301. Also, sled 300 can comprise ledge 305 extending laterally outward from the sled second longitudinal side wall 302, the ledge disposed toward the back transverse wall 304 of the sled 300. As illustrated (see e.g., FIG. 13), ledge 305 is recessed somewhat relative to the rim of side wall 302 at the corner of side wall 302 and back transverse wall 304.

Turning now to FIGS. 1-3, illustrating that printhead 500 used in the alignment assemblies described herein, can be operably coupled to base 400, wherein base 400 has anterior face 401A (see e.g., FIG. 1) and posterior face (not shown), base 400 comprising anterior tag 405 extending laterally from anterior face 401A, tag 405 configured to align with sled's 300 overhang 310 base plate 314 and couple thereto. Rails 501 (see e.g., FIG. 1), are adapted to operably slidably couple to sled 300 side walls (301, 302), as well as side walls 240, 241 of carriage 200 and provide the registration of printheads 500.

Figure 12:
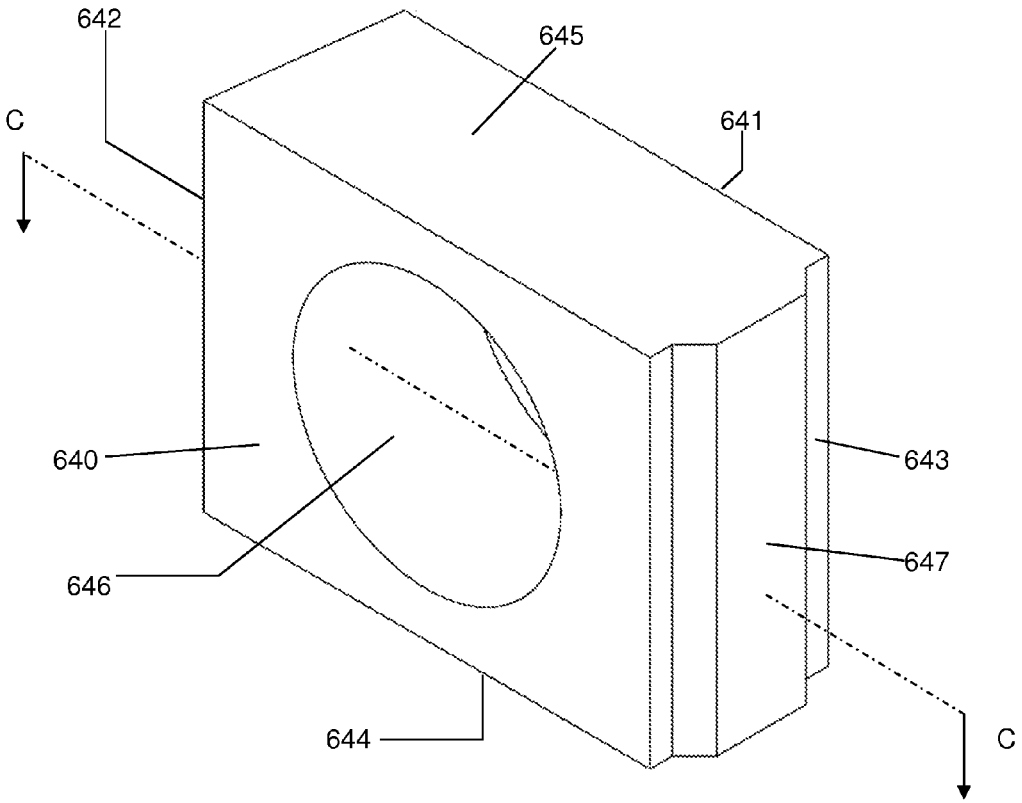
FIG. 12, illustrates an isometric view of an embodiment of the cube-shaped alignment nut.
Figure 13:
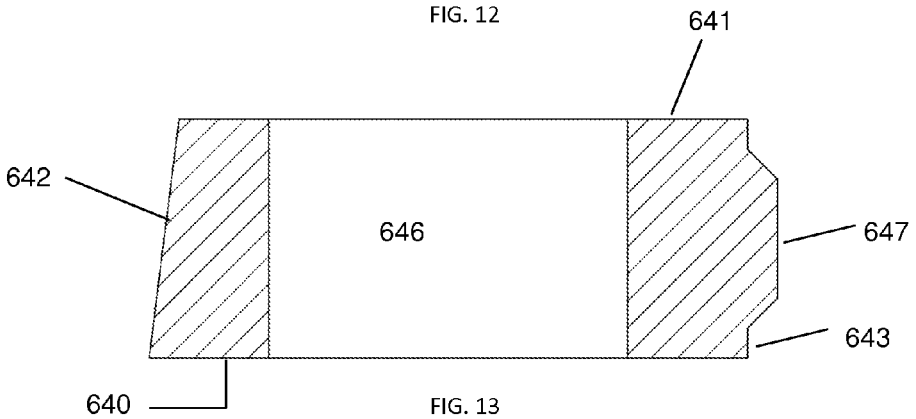
FIG. 13, illustrates a schematic X-Y cross section A-A view of the embodiment of the cube-shaped alignment nut illustrated in FIG. 12.

Turning now to FIGS. 1-3, 12, and 13, illustrating embodiments of the phase actuator. The phase actuator used in the alignment assemblies described herein, can comprise a cube-shaped nut 600 (see e.g., FIGS. 1, 12) defining a threaded cylindrical aperture 646 (FIG. 12), extending through from front facet 640 to rear facet 641, parallel top facet 645 and bottom facet 644, and parallel left facet 642 and right facet 643. As illustrated in FIG. 13, front facet 640 can be larger than the rear facet 641, such that top facet 645 and bottom facet 644 define a cross section (see e.g., FIG. 13) right angle trapezoid forming a side wall having straight right facet 643 and a left wall or facet that is beveled 642. As illustrated in FIGS. 2, 12, and 13, right facet 643 can further define a rail, 647 extending vertically along straight right facet 643 having a generally trapezoidal cross section (see e.g., FIG. 13).

As illustrated in FIG. 1, the phase actuator used in the alignment assemblies described herein, can also have phase calibration detent 601. Detent 601, (e.g., which an element configured to fit into a notch, pocket, bore, depression and the like, locking or unlocking movement), can have head portion 602 (e.g., configured to receive an adjustment tool, for example, an ELLEN™ wrench), blunt tip 604 and threaded portion 603 therebetween. Detent 601 can be configured to couple cube-shaped nut 600, to carriage 200; for example through bore 245, providing a fulcrum for the phase translation of carriage 200 in mounting platform 100.

Turning now to FIGS. 3, and 9B, where phase biasing element 605A can be adapted to abut external surface 212 of front and back phase adjustment tabs 210A, 210B, and bias front and back phase adjustment tabs 210A, 210B from the wall of tetragonal recess pairs 103$_p$, and 104$_q$.

As further illustrated in FIGS. 3, and 9B an Detent 601 can be used in the phase actuator and can comprise; head portion 602 (e.g., configured to receive an adjustment tool, for example, a PHILLIPS™ screw driver), blunt tip 604 and threaded portion 603 disposed therebetween. Beveled facet 642 of cube-shaped nut 600, can be positioned to abut beveled surface 211 of front and back phase adjustment tabs 210A, 210B, such that rotating detent 601 rotatably coupled to basal aperture 245A, 245B defined respectively in front transverse wall 242 and back transverse wall 243, causes cube-shaped nut 600 to slide against beveled internal surface 211 of carriage 200 front and back phase adjustment tabs 210A, 210B, translating carriage 200 against phase biasing element 605A, 605B thereby creating motion of printheads 500 relative to each other on the x-axis.

Phase translation anchor 630 can similarly have head portion 631, flanged mid portion 632, and tip 633. The tip can be configured to operably couple to front stage bore 105$_m$ and back stage bore 106$_n$ of the mounting platform 100 used in the alignment assemblies described herein, bores 105$_m$ and 106$_n$ each respectively disposed between each front stage 101F recess 103$_p$, back stage 101B recess 104$_q$ and the internal space defined by front stage 101F, back stage 101B and the side rails 102. Phase translation anchor 630 can be engaged to bores 105$_m$, 106$_n$, through slits 221A, 221B in right partially cylindrical channel, such that it can act as an axle hinge for the lateral movement of carriage 200. As indicated, causing the turning of phase calibration detent 601 to articulate cube-shaped nut 600 forward and phase biasing elements 605A, 605B to move adjustment tabs 210A, 210B toward tetragonal recesses' 103$_p$, 104$_q$ wall. Since, as illustrated in FIGS. 3, and 9B, balanced adjustment of the tabs (in other words, to the same extent in the same x-axis direction) can affect solely phase alignment of printheads 500, while unbalanced (in other words, either not to the same extent, to the same extent in opposite direction, or not to the same extent in the opposite direction on the x-axis) can affect the yaw alignment of printheads 500.

The registration actuator, in other words, the y-axis alignment actuator used in the alignment assemblies described herein is illustrated in several FIGS., for example, FIGS. 1-3, 7, 10, and 11. As indicated hereinabove, each of front 230A and back 230B registration actuator housings can be a tetragonal structure (in other words, box shaped, see e.g., FIG. 7) with a side wall that rises above and continuous with the edge of each extension slab 220A, 220B, with an outward (to the front in 230A or rear in 230B) facing wall defining a threaded aperture 231A, 231B respectively, and an open inward (to the internal space formed by carriage 200 walls) facing space 232A, 232B. In addition, the registration actuator can further comprise translator member 610 (see e.g., FIG. 1, having the same structure as detent 601 described herein i.e., having head portion 602 (e.g., configured to receive an adjustment tool, for example, a flat head screw driver), threaded midsection 603 coupled to nut member 620. Translator member 610 can be threaded via threaded midsection 603 through the aperture 231A, 231B respectively, such that head portion 602 can remain outside of housing 230A, 230B and nut member 620 can be slidably coupled inside the housing 230A, 230B. In an embodiment, the term "slidably coupled" refers to elements (e.g., nut member 621 and the inside of housing 230), which are coupled in a way that permits one element (e.g., nut member 620) to slide or translate with respect to another element (e.g., inside of housing 230). As illustrated in FIG. 2, nut member 620 can be configured to abut the anterior surface of anterior wall 312 in sled's 300 overhang 310. Turning the translator member will push on the anterior surface of anterior wall 312 in sled's 300 overhang 310 causing rails 501 to slide along side rails 301, 302 and enable the registration alignment of sled 300 in the y-axis direction.

While in the foregoing specification the assemblies kits and methods allowing alignment of inkjet printheads by selectably modulating phase, registration, and yaw have been described in relation to certain preferred embodiments, and many details are set forth for purpose of illustration, it will be apparent to those skilled in the art that the disclosure of the assemblies and methods allowing alignment of inkjet printheads by selectably modulating phase, registration, and yaw is susceptible to additional embodiments and that certain of the details described in this specification and as are more fully delineated in the following claims can be varied considerably without departing from the basic principles of this disclosure.

What is claimed is:

1. An assembly for aligning printheads comprising:

a. a mounting platform having a front stage, a back stage and a pair of side rails connecting the front and back stages, the mounting platform comprising at least two linear phase actuators and defining an internal quadrilateral space, wherein each of the front stage and back stage each comprises a pair of parallel tetragonal recesses, each recess pair defining a top opening;

b. a carriage operably coupled to the mounting platform, further comprising a phase translation anchor and a registration actuator;

c. a sled, nested within—and operably coupled to, the carriage; and d. an inkjet printhead, operably coupled to the sled, wherein the front stage recess further defines a front opening, and the back stage recess defines a rear opening, the assembly is configured to provide three degrees of freedom (DOF) alignment to the printhead relative to the printing direction and optionally with respect to a second printhead.

2. The assembly of claim 1, wherein the three degrees of freedom are phase, registration, yaw, or any permutation of the foregoing.

3. The assembly of claim 2, wherein each each; the recess pair in each of the front stage and back state is configured to receive and engage at least a portion of the carriage and the linear phase actuator.

4. The assembly of claim 3, wherein a front stage bore and a back stage bore is disposed between each front stage recess, back stage recess and the internal space defined by the front stage, back stage and the side rails.

5. The assembly of claim 4, wherein the carriage defines a substantially rectangular frame having a longitudinal axis with a pair of long longitudinal side walls connected by shorter front and back transverse walls, all walls rising at the edges of a substantially rectangular floor plate defining a substantially rectangular opening therein, the carriage comprising:

a. a front and a back extension slabs each extension slab having an upper surface and a lower surface, the front and a back extension slabs each defining a slit therein, configured to accommodate at least a portion of the phase translation anchor;

b. a front and back phase, yaw, or phase and yaw adjustment tabs, extending downward from the lower surface of each front and back extension slab respectively; and c. a front and back registration actuator's housing.

6. The assembly of claim 5, wherein the front transverse wall and back transverse wall—each further define a basal aperture, configured to receive and accommodate at least a portion of the phase actuator.

7. The assembly of claim 6, wherein the front and back phase, yaw or phase and yaw adjustment tabs extending downward from the lower surface of each front and back extension slab respectively define a trapezoid X-Y cross section having a beveled internal surface and a straight external surface, configured to abut a portion of the phase actuator.

8. The assembly of claim 7, wherein the beveled internal surface of each adjustment tab is configured to abut at least a portion of the phase actuator.

9. The assembly of claim 8, wherein phase biasing elements configured to bias the straight external surface of each of the adjustment tabs away from a wall of the tetragonal recess pairs are disposed in the front stage and the back stage of the mounting platform.

10. The assembly of claim 9, wherein the sled defines a substantially rectangular open frame having a first and a second long longitudinal side walls connected by shorter front and back transverse walls, the sled comprising:

a. an overhang having an anterior wall with an anterior surface extending above the front wall, a side wall, both rising from a base plate extending laterally outward from the sled first longitudinal side wall;

b. a ledge extending laterally outward from the sled second longitudinal side wall, the ledge disposed toward the back transverse wall of the sled.

11. The assembly of claim 10, wherein the printhead is operably coupled to a base, wherein the base has an anterior face and a posterior face, the base further comprising:

a. an anterior tag extending laterally from the anterior face, the tag configured to align with sled's overhang base plate; and b. a pair of rails configured to slidably couple to the first and second longitudinal side walls of the sled.

12. The assembly of claim 11, wherein each phase actuator comprises:

a. a cube-shaped nut defining a threaded cylindrical aperture, extending through from a front facet to a rear facet, a parallel top facet and a bottom facet, and a parallel left facet and a right facet, wherein the front facet is larger than the rear facet, such that top facet and bottom facet define a right angle trapezoid cross section with a straight left facet and a beveled right facet, and wherein the straight left facet defines a rail extending the vertical length of the left facet; and b. a phase calibration detent having a head portion, a blunt tip and a threaded portion therebetween, the detent configured to couple the cube-shaped nut, to the carriage.

13. The assembly of claim 12, wherein the phase calibration detent is configured to couple to the carriage through the centrally located basal aperture defined in the shorter front and back transverse walls of the carriage.

14. The assembly of claim 13, wherein each of the front and back registration actuator's housing respectively comprises an anterior facing threaded aperture and a posterior facing threaded aperture, each housing defining an opening opposite the aperture.

15. The assembly of claim 14, wherein the registration actuator comprises a translator having a head portion, a threaded midsection coupled to a nut member, the translator threaded through the threaded aperture such that the head portion is outside of the housing and the nut member is slidably coupled inside the housing.

16. The assembly of claim 15, wherein the nut member is configured to abut the anterior surface of anterior wall in the sled overhang.

17. The assembly of claim 16, wherein the phase translation anchor is configured to be accommodated in the opening defined in each of the front and a back extension slabs of each carriage.

18. The assembly of claim 17, wherein the phase translation anchor is configured to engage bores defined on the surface of the front and back stages of the mounting platform.

19. A kit comprising:

a. a mounting platform having a front stage, a back stage and a pair of side rails connecting the front and back stages and a pair of side rails connecting the front and back stages, the mounting platform comprising at least two linear phase actuators and defining, an internal quadrilateral space, wherein each of the front stage and back stage each comprises a pair of parallel tetragonal recesses, each recess pair defining a top opening;

b. a carriage;

c. a sled;

d. an inkjet printhead;

e. optionally an adjustment tool; and f. optionally, instructions, the mounting platform, carriage, sled and inkjet printhead configured to be assembled to form an assembly for aligning inkjet printheads.

* * * * *